US005301808A

United States Patent [19]

Pierson

[11] Patent Number: 5,301,808

[45] Date of Patent: Apr. 12, 1994

[54] COSMETIC ORGANIZER

[75] Inventor: Theodore J. Pierson, Kinnelon, N.J.

[73] Assignee: Pierson Industries, Inc., Rockaway, N.J.

[21] Appl. No.: 975,642

[22] Filed: Nov. 13, 1992

[51] Int. Cl.[5] ..... A45C 11/00; A45C 11/34; B65D 83/02; B65D 85/26

[52] U.S. Cl. ..... 206/581; 132/297; 132/318; 312/9.16; 312/9.24

[58] Field of Search ..... 206/1.5, 37.2, 232, 206/581, 387; 132/294, 297, 317, 318; 312/9.16, 9.21, 9.23, 9.24, 9.25

[56] References Cited

U.S. PATENT DOCUMENTS

| | | | |
|---|---|---|---|
| 1,632,864 | 6/1927 | Weber . | |
| 1,703,091 | 2/1929 | Bass . | |
| 1,709,990 | 4/1929 | Lungren . | |
| 1,750,983 | 3/1930 | Zell . | |
| 1,879,570 | 9/1932 | Sopsko . | |
| 2,010,521 | 8/1935 | Kreisler . | |
| 2,010,909 | 8/1935 | Zell . | |
| 2,331,764 | 10/1943 | Campos . | |
| 2,547,971 | 4/1951 | Polin et al. . | |
| 2,570,341 | 10/1951 | Hake . | |
| 2,585,452 | 2/1952 | Friedlund . | |
| 3,809,102 | 5/1974 | Ross . | |
| 4,121,877 | 10/1978 | Brown | 312/9.23 |
| 4,162,112 | 7/1979 | Konkler | 312/9.25 |
| 4,421,127 | 12/1983 | Geer . | |
| 4,526,273 | 7/1985 | Tsuji et al. . | |
| 4,555,020 | 11/1985 | Campello et al. . | |
| 4,562,923 | 1/1986 | Katada et al. . | |
| 4,632,248 | 12/1986 | Hsu | 206/387 |
| 4,666,043 | 5/1987 | Tahara | 206/581 |
| 4,678,245 | 7/1987 | Fouassier | 206/387 |
| 4,679,576 | 7/1987 | Yuhara et al. . | |
| 4,683,899 | 8/1987 | Yuhara et al. . | |
| 4,702,533 | 10/1987 | Seifert | 206/387 |
| 4,834,122 | 5/1989 | Yuhara et al. . | |
| 4,858,765 | 8/1989 | Nakamura et al. . | |
| 4,930,528 | 6/1990 | Hatakeyama . | |
| 4,972,860 | 11/1990 | Yuhara et al. . | |
| 4,989,622 | 2/1991 | Kozuka et al. . | |
| 5,050,623 | 9/1991 | Yuhara et al. . | |
| 5,078,159 | 1/1992 | Yuhara . | |
| 5,092,354 | 3/1992 | Pacelli, Jr. . | |

*Primary Examiner*—David T. Fidei
*Attorney, Agent, or Firm*—Lerner, David, Littenberg, Krumholz & Mentlik

[57] ABSTRACT

A cosmetic organizer for retaining a plurality of cosmetic products and cosmetic applicators within a housing is disclosed. The cosmetic organizer comprises at least one cosmetic applicator receptacle device for receiving and retaining corresponding cosmetic applicators therein. The receptacle device is movable between a retracted position at which it is retained within a housing so that it cannot be removed therefrom, and a projected position at which it is arranged at least partially outside of the housing and can easily be removed therefrom. An ejection device is arranged in the housing for forcing the cosmetic holding device from its retracted position to its projected position. A latch mechanism is used to secure the cosmetic holding device in its retracted position and to selectively permit the cosmetic holding device to move to its projected position. A sealing device is provided to prevent the cosmetic applicators from drying out when stored within the housing.

25 Claims, 5 Drawing Sheets

COSMETIC ORGANIZER

BACKGROUND OF THE INVENTION

The present invention relates to cosmetic organizers for selectively retaining at least one cosmetic applicator.

Cosmetics such as eyeliner, lip gloss, lipstick, blush, etc. are frequently used by women during the course of the day or night when they are away from home. Without the aid of a cosmetic organizer for storing such cosmetics, women are often faced with no alternative but to fumble through their pocketbooks to look for a particular type of cosmetic such as a particular color eyeliner or a particular type of lipstick. Thus, there is a great need for a cosmetic organizer which will permit a user of cosmetics to easily locate and access the cosmetic desired.

For example, it is common for women to apply make-up in their car while stuck in traffic or at a traffic light. This is often a difficult task because there is usually little time available to apply the make-up. The lack of space available in the car is another factor which complicates the task of applying make-up. Therefore, it would be a great benefit if a cosmetic case, such as the cosmetic organizer of the present invention, permitted quick and easy accessibility to the desired cosmetic or cosmetic applicator stored therein.

The prior art is replete with portable cosmetic cases for organizing and storing a plurality of cosmetics and cosmetic applicators. The crowded art is indicative of the significant effort which has been expended by inventors to develop an effective and efficient cosmetic case. However, prior art cosmetic cases generally do not provide the degree of accessibility to the cosmetic applicators stored therein that is needed to serve its intended purpose.

In this regard, no known cosmetic case permits a user to select one of a plurality of cosmetic applicators which can then be effortlessly removed from the cosmetic case by triggering a single latch mechanism while the unselected cosmetic applicators remain stored therein. Moreover, no known cosmetic case provides a sealing device in combination with a cosmetic applicator, such as a cosmetic pencil, to prevent the cosmetic pencil from drying out. Prior art cosmetic cases such as those disclosed in U.S. Pat. Nos. 4,562,923 to Katada et al.; 2,331,764 to Campos and 1,632,864 to Weber all have one or more significant drawbacks which have been addressed by the cosmetic organizer of the present invention.

Despite all of the effort which has been devoted to development of cosmetic cases, the prior art cosmetic cases include many shortcomings which have not heretofore been addressed. The existence of these shortcomings in the prior art devices demonstrates that there is a need for an improved cosmetic organizer for retaining a plurality of cosmetics and cosmetic applicators. In particular, there has been an unsolved need for a cosmetic organizer which provides easy accessibility to a selected one of a plurality of cosmetic applicators. Furthermore, there has been a need for a cosmetic organizer as described above which includes a sealing device to prevent each of the stored cosmetic applicators from drying out.

The present invention addresses each of the aforementioned needs of the prior art cosmetic cases and thus, provides a cosmetic organizer having a new and unobvious structure and operation which produces advantages that have not heretofore been achieved. The present cosmetic organizer will clearly benefit all users of cosmetic products who have experienced the need for a portable cosmetic organizer which provides easy accessibility to cosmetic products and cosmetic applicators stored therein.

SUMMARY AND OBJECTS OF THE INVENTION

A cosmetic organizer for selectively retaining at least one cosmetic applicator is provided in accordance with one aspect of the present invention. The cosmetic organizer comprises a housing in which a plurality of cosmetics and cosmetic applicators are retained. The cosmetic organizer also comprises receptacle means for receiving and retaining at least one cosmetic applicator therein. The receptacle means is movable between a retracted position at which the receptacle means is retained within the housing so that it cannot be removed therefrom and a projected position, at which the receptacle means is arranged at least partially outside the housing and can be readily removed therefrom. The cosmetic organizer also comprises moving means arranged in the housing for moving the securing means from the retracted position to the projected position, and locking means for selectively retaining the receptacle means in the retracted position within the housing. The locking means is positionable between a first position wherein it engages the receptacle means so that the receptacle means is retained in the retracted position and a second position wherein it is disengaged from the receptacle means and the moving means is operative to move the receptacle means to the projected position.

In one preferred embodiment, the locking means includes pivot means for facilitating movement of the locking means between a first position at which the securing means is held in the retracted position and a second position at which the moving means acts to force the receptacle means to the projected position.

In another preferred embodiment, the locking means comprises a first elongate member having a projection thereon. The projection is adaptable to be releasably engaged with the receptacle means so that the receptacle means can move from the retracted position to the projected position. In another preferred embodiment, the locking means is arranged to extend between the interior of the housing and the exterior thereof. It is also preferable for the first elongate member to have an arcuate shape and to include a groove arranged between the first end and the second end thereof, wherein the groove defines a recess for receiving a second elongate member. The first and second elongate members have respective first and second axes. The second elongate member is connected to the first elongate member so that the second axis is arranged transverse to the first axis. The second elongate member is adapted to be rotatably mounted within the housing of the cosmetic organizer.

Another aspect of the present invention provides a plurality of trays arranged in the housing of the cosmetic organizer for retaining at least one cosmetic product therein. The cosmetic organizer, according to this preferred embodiment, may also comprise a cover pivotally connected to the housing so that it can be selectively moved between a closed position, at which it is arranged adjacent to the plurality of trays, and an open position at which the cover is remote from the trays.

Another aspect of the present invention provides a cosmetic organizer comprising a housing for retaining a plurality of cosmetics and cosmetic applicators. The cosmetic organizer according to this aspect of the present invention also comprises receptacle means for receiving and retaining at least one cosmetic applicator therein. The receptacle means is movable between a retracted position at which it is retained within the housing so that it cannot be removed therefrom, and a projected position at which it is arranged at least partially outside of the housing and can be readily removed therefrom. The cosmetic organizer also comprises moving means arranged in the housing for moving the receptacle means from the retracted position to the projected position. Additionally, locking means are provided for selectively retaining the receptacle means in the retracted position within the housing. Sealing means for preventing a respective cosmetic applicator from drying out is also provided in this preferred embodiment of the present invention and is releasably connected to the receptacle means.

In another preferred embodiment, the sealing means comprises a sized and shaped container having one opening therein and is releasably attached to the receptacle means at the opening so that a seal is formed therebetween.

Accordingly, it is an object of the present invention to provide a cosmetic organizer having a new and useful structure which overcomes several shortcomings of known cosmetic organizers.

It is another object of the present invention to provide a cosmetic organizer which is sufficiently portable and compact to fit within a woman's pocketbook.

It is another object to the present invention to provide a cosmetic organizer which permits quick accessibility to a desired cosmetic or cosmetic applicator toward therein.

It is yet another object of the present invention to provide a cosmetic organizer which will retain a plurality of cosmetic applicators and cosmetics within a housing while permitting a selected cosmetic applicator to be readily removed therefrom.

It is still another object of the present invention to provide a cosmetic organizer having sealing means for preventing cosmetic applicators, such as cosmetic pencils, stored therein from drying out.

These and other objects of the present invention will be more clearly understood when read in conjunction with the detailed description and the accompanying drawings which follow.

DETAILED DESCRIPTION OF THE PREFERRED EMBODIMENTS

The cosmetic organizer in accordance with one embodiment of the present invention will now be described with reference to FIGS. 1-6. The cosmetic organizer, generally designated 10, includes a rectangular housing 12. A cover 30 is pivotably attached by a hinge 28 to the housing 12 which defines a compartment for retaining lipstick therein.

Figure 1:
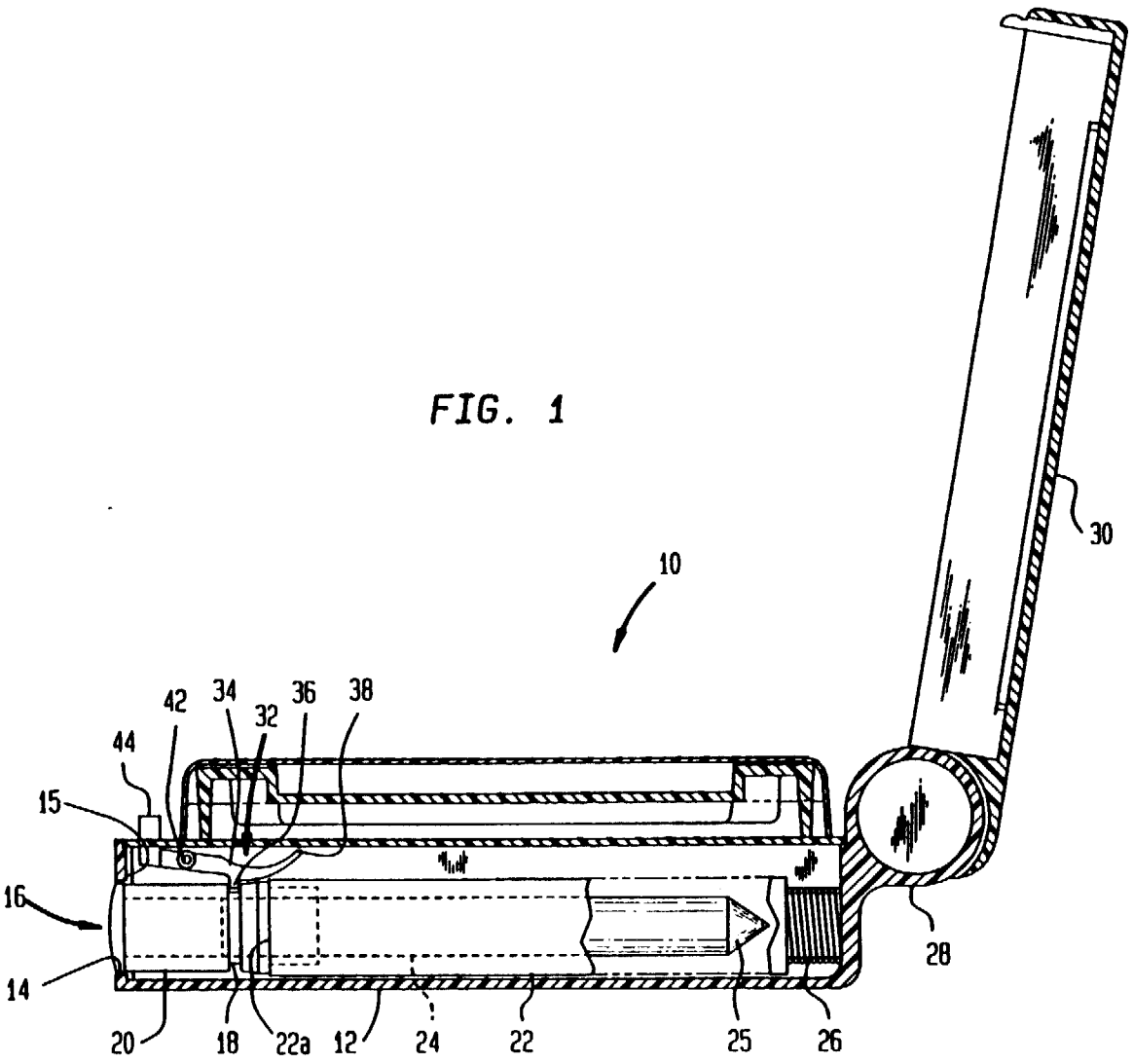
FIG. 1 is a side partial sectional view of one embodiment of the cosmetic organizer of the present invention.
Figure 2:
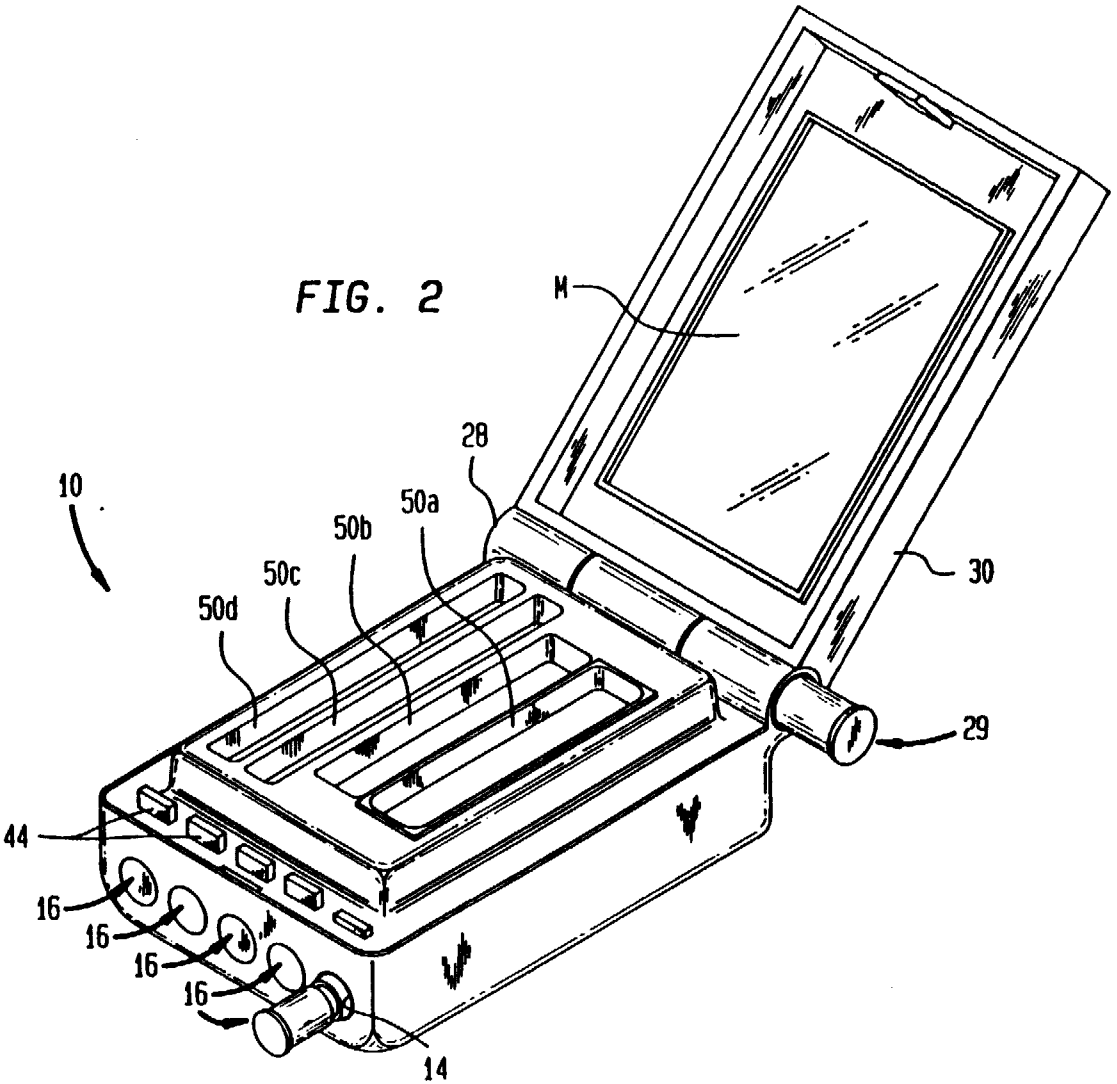
FIG. 2 is a front perspective view of the cosmetic organizer shown in FIG. 1 with a lipstick applicator extending out of the hinged cavity.
Figure 5:
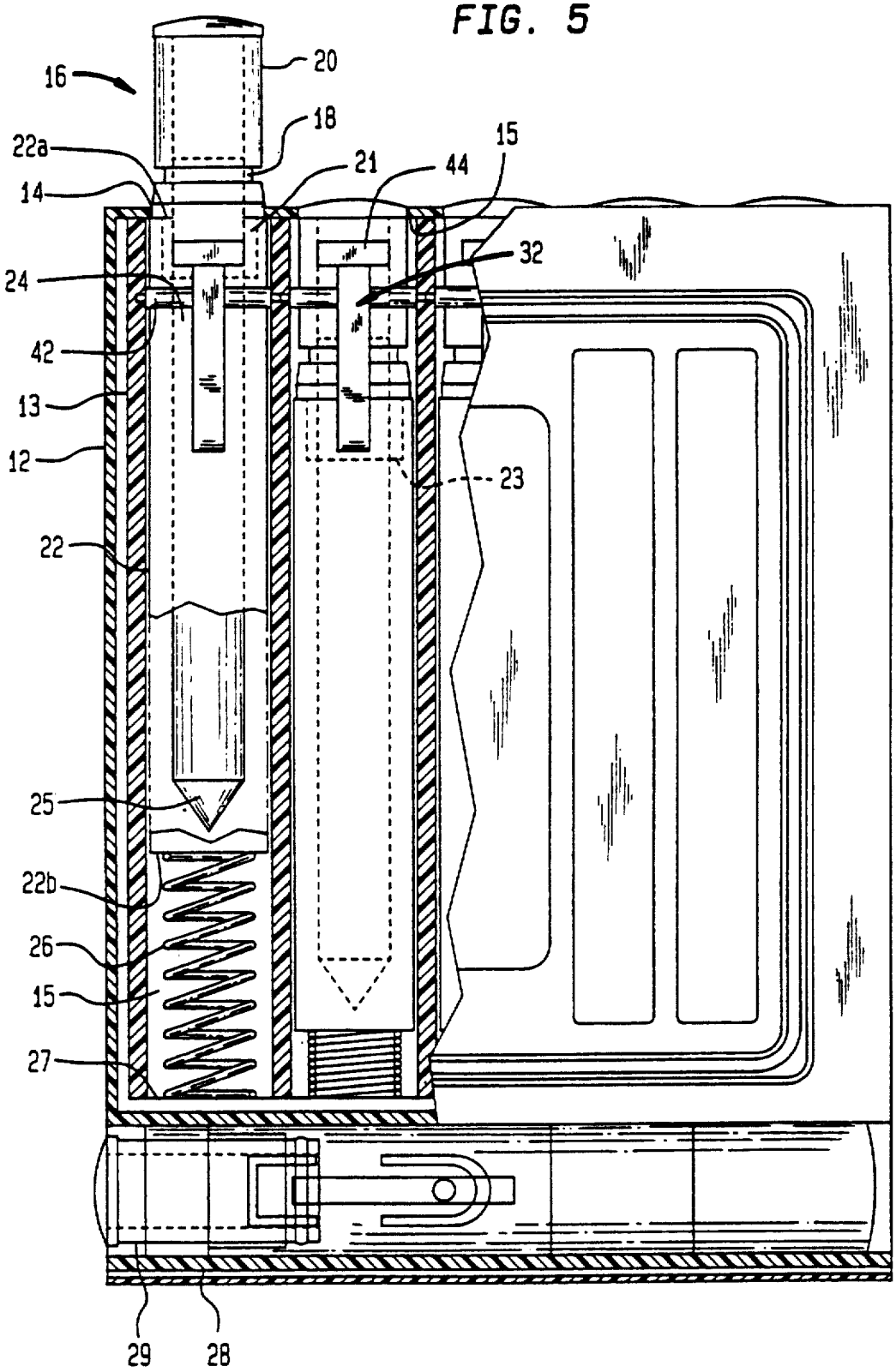
FIG. 5 is partial cross-sectional view of the cosmetic organizer shown in FIGS. 1 and 2 with one cosmetic pencil in its projected position and other cosmetic pencils in their retracted position.
Figure 6:
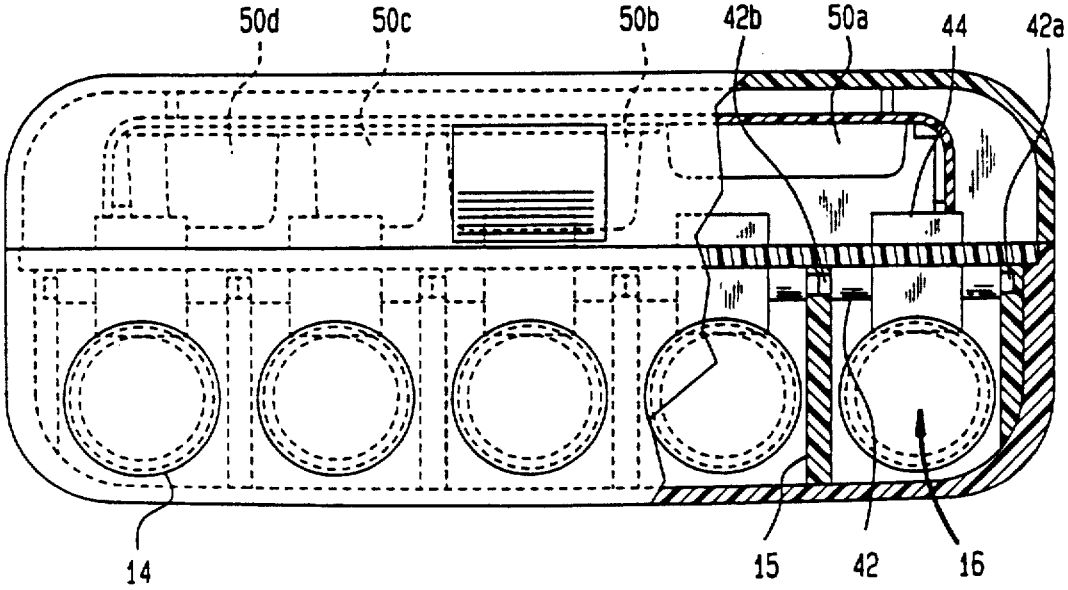
FIG. 6 is a front cross-sectional view of the cosmetic organizer shown in FIGS. 1, 2 and 5.

The housing 12 includes a plurality of dividing walls 13 which define cavities or storage compartments 15 in which a corresponding number of cosmetic applicators and cosmetic applicator capsules 22 can be stored through apertures 14. A plurality of cosmetic applicator receptacles 16 are preferably adapted to fit within the apertures 14 of the housing 12. As shown in FIGS. 1 and 5, the cosmetic applicator receptacles 16 include a large diameter portion 20 which is arranged to extend into the cavities 15 through the apertures 14. It is also preferable for each of the cosmetic applicator receptacles 16 to include a groove 18 positioned adjacent the large diameter portion 20 of the body 21. Each of the cosmetic applicator receptacles 16 are hollow and include a sized and shaped opening 23 adapted to receive an elongate cosmetic applicator 24, such as a cosmetic pencil, which is stored in the storage compartments 15 therein.

A cosmetic applicator capsule 22 is arranged within each of the storage compartments 15. Each of the capsules 22 are adapted to accept a corresponding cosmetic pencil 24 through an opening in the first end **22*a* thereof. The capsules 22 are preferably cylindrical, however, they may alternatively have a rectangular shape or other acceptable shape. The opening within the first end 22*a* of the capsule 22 is adapted to form a seal with respect to the body 21 of the cosmetic applicator receptacle 16 and thus, the capsules 22 protect respective cosmetic pencils from drying out. This feature of the present invention can best be appreciated from the embodiment shown in FIGS. 1 and 5**.

It is preferable for a plurality of elongate cosmetic applicators 24, such as eye-liner pencils, to include a first end adapted to be releasably held within respective cosmetic applicator receptacles 16, and a second end 25 adapted to extend into the cavity of a respective capsule 22, as best shown in FIGS. 1 and 5. The second end 25 of the cosmetic pencils will be referred to herein as the "applicator end", i.e., the end containing the make-up to be applied by a desired user.

As will be described in more detail hereinbelow, the cosmetic applicator receptacles 16 and their respective capsules 22 are movable between a retracted position, at which the cosmetic applicator receptacles 16 are preferably arranged substantially within the housing 12, and a projected position, at which the applicator holders 16 are arranged substantially outside of the housing 12.

A plurality of springs 26 are arranged within the housing and extend between a base wall 27 and a second end **22*b* of a respective capsule 22. This feature of the present invention is clearly shown in FIGS. 1 and 5**.

Figure 3:
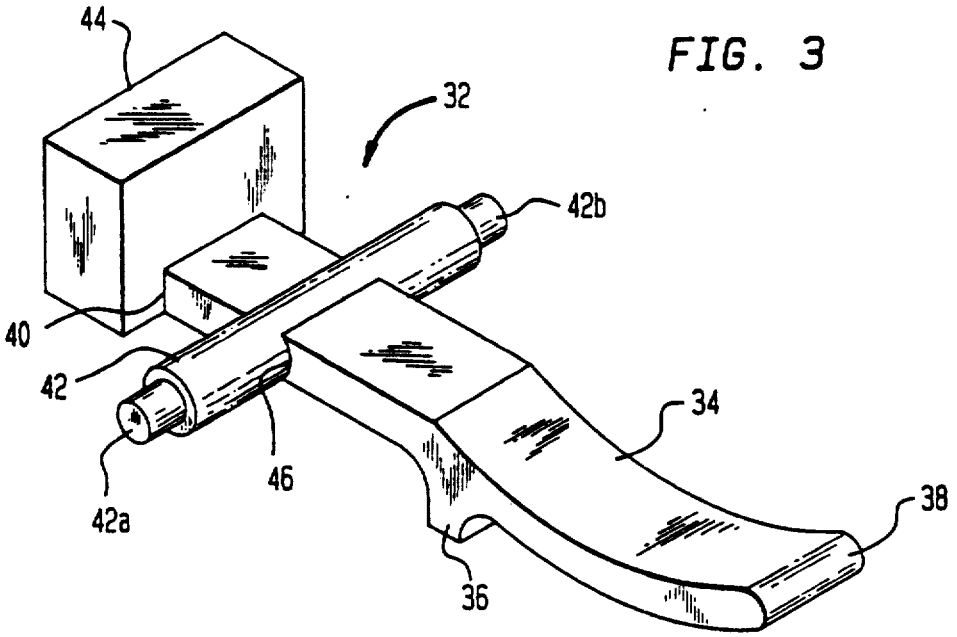
FIG. 3 is an enlarged perspective view of one embodiment of the locking means of the present invention.
Figure 4:
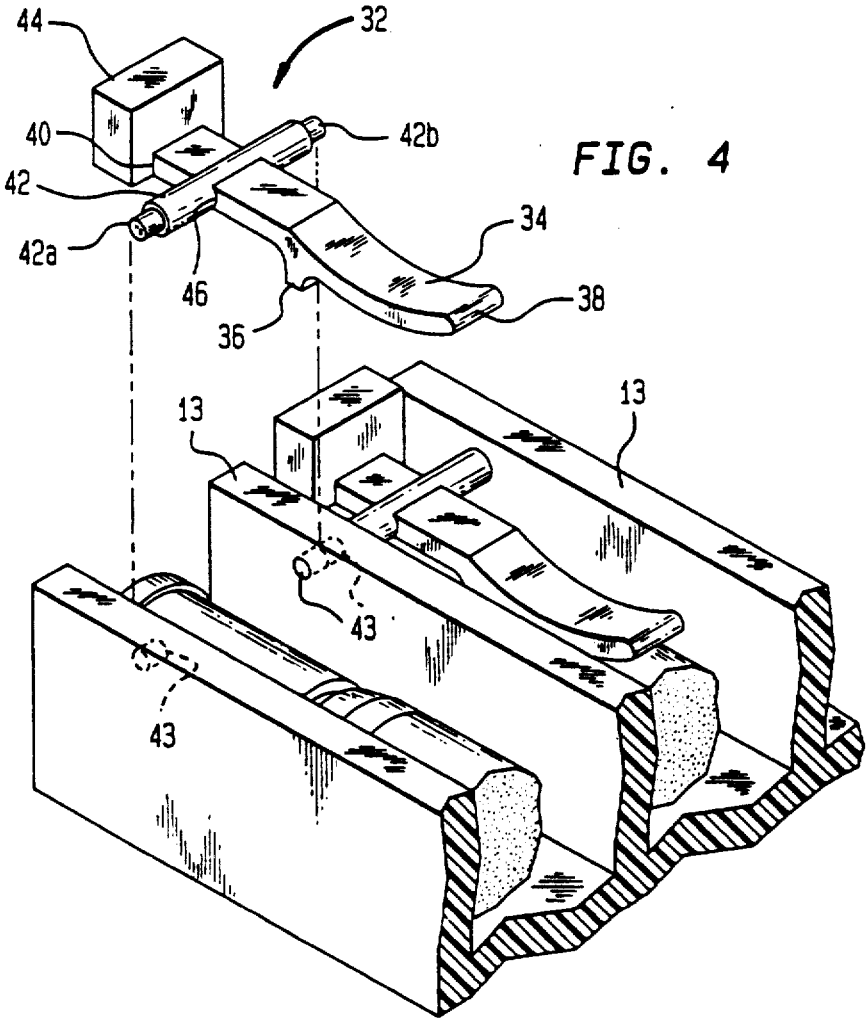
FIG. 4 is a broken-away partially exploded view of the locking means shown in FIG. 3 arranged in the housing of the present invention.

A latch generally designated 32 in FIGS. 1, 3 and 4 comprises a first elongate arcuate member 34 having a first end 38 and a second end 40. The elongate arcuate member 34 includes a sized and shaped projection 36 adapted to be operatively and releasably engaged with the groove 18 in the body 21 of a respective cosmetic applicator receptacle 16. The shape and the degree of the arc of the elongate member 34 can be varied to adjust the desired tension required to move the latch 32 from an engaged position with respect to the pencil receptacle 16 to a disengaged position.

The arcuate member 34 preferably includes a sized and shaped groove 46 arranged to receive an elongate pivot member 42 therein. It is preferable for the pivot member 42 to have a cylindrical body however, it may comprise various alternative shapes while remaining within the scope of the present invention. As best shown in FIGS. 3 and 4, the cylindrical pivot member 42 is arranged transverse with respect to elongate arcuate member 34.

The pivot member 42 includes a first end 42*a* and a second end 42*b*. In the preferred embodiment of FIGS. 3 and 4, the ends 42*a* and 42*b* are also cylindrical. The cross-sectional diameter of pivot member ends 42*a* and 42*b* is smaller than the cross-sectional diameter of the body of the pivot member 42 to which they are attached. As can be appreciated with reference to FIG. 4, the dividing walls 13 of the cosmetic organizer 10 comprises a plurality of internal ports 43 adapted to receive the cylindrical ends 42*a* and 42*b* of the pivot member 42 when the latch 32 is placed in its assembled position within the dividing walls 13 and the housing 12.

The second end 40 of the arcuate member 34 is preferably connected to a release button 44 which extends from the interior of the housing to an exterior portion thereof when the latch 32 is in an assembled position as shown in FIGS. 1 and 4. Although the release button 44 is depicted as having a rectangular shape in FIGS. 1–6, it may comprise a variety of alternative shapes including a circular shape suitable for initiating the pivotable feature of the latch 32. As can best be appreciated with reference to FIG. 1, the first end 38 of the arcuate member 34 is adapted to abut an interior wall of the housing 12 when the projection 34 is disposed within a groove 18 of a respective cosmetic applicator receptacle 16.

Most preferably, the latch 32 is made of a flexible material such as polypropylene. Alternatively, the resilient arcuate member 34 may comprise many other polymers or plastic materials having suitable elasticity characteristics.

In another preferred embodiment, the cosmetic organizer 10 comprises a plurality of trays 50*a*–50*d* which are suitably sized and shaped to hold a variety of cosmetics, such as blush, and a cosmetic applicator, such as a brush for applying the brush to the face of the user.

In yet another preferred embodiment, the cosmetic organizer 10 includes a mirror M arranged within the inner wall of the cover 30 to permit a user to see herself when applying the cosmetics contained within the cosmetic organizer 10. Such an embodiment is clearly shown in FIG. 2. The cosmetic organizer 10 of the present invention is sufficiently compact so that a woman can easily store it within her pocketbook. Thus, the cosmetic organizer 10 of the present invention provides a central location for storing a plurality of cosmetics and cosmetic applicators so that a particularly desired cosmetic applicator can easily and quickly be found and applied.

When the cosmetic organizer 10 is not in use it is usually stored with the cover 30 closed to protect the contents of the trays 50*a*–50*d* and with each of the cosmetic applicator receptacles 16 arranged in their retracted position within the housing 12. The springs 26 are compressed under tension when the cosmetic applicator receptacles 16 and the capsules 22 are retained in the retracted position. As can be appreciated, when the springs 26 are compressed, they constantly exert a force against the base 27 of the housing 12 and the second end 22*b* of a respective pencil capsule. Thus, the capsules 22 and the respective cosmetic applicator receptacles 16 are constantly urged toward the apertures 14. However, as discussed above, they are retained in the retracted position so long as the projection 36 of the latch member 32 is arranged within the groove 18.

When one desires to use a particular cosmetic, such as a cosmetic pencil 24, the portion of the release button 44 which extends out of the housing 12 must be depressed. The downward pressure on the release button 44 forces the resilient arcuate member 34 to pivot about the cylindrical pivot member 42. Thus, the first end 38 of the resilient arcuate member 34 is forced upwardly until it deforms and slides along the inner wall of the housing 12. Thus, the projection 36 begins to move away from the grooved area 18 within the cosmetic pencil holder 16.

If one continues to apply increasing pressure to the release button 44, the projection 36 eventually becomes entirely displaced out of the groove 18. The spring 26 then immediately expands to its relaxed position and thereby moves the respective cosmetic applicator receptacle 16 and the respective capsule 22 to their projected position. The above-described operation can best be appreciated with reference to FIG. 5, wherein one of the springs is shown in its relaxed position while its associated cosmetic applicator receptacle 16 and capsule 22 are arranged in their projected positions and the other four springs are retained in their compressed positions.

Each of the cosmetic pencils 24 can be individually removed from the housing 12, while the other cosmetic pencils are retained therein and cannot be removed therefrom. This feature of the present invention is particularly desirable in situations when a user chooses to select one particular cosmetic pencil without removing the other cosmetic pencils from the housing 12. However, when the cosmetic pencils 24 are actuated to their respective projected positions, they can be readily removed from the housing and in fact, in the preferred embodiment of the present invention, there are no means whatsoever for retaining the cosmetic pencils in the housing when they are in their projected position. Most preferably, each of the cosmetic pencils 24 are retained within a respective hollow cosmetic applicator receptacle 16 by means of frictional engagement members (not shown) which provide sufficient forces to retain the pencils therein during normal use of same. However, the pencils can be removed from the holders by applying a sufficient amount of force to overcome the frictional engagement therebetween, as may be the case when one desires to insert a new pencil 24 within a particular receptacle 16.

The capsules 22 serve the purpose of prolonging the life of the cosmetic pencils, so that the applicator end 25 does not dry out, by forming a sufficient seal between first end 22*a* and the body 21 of the cosmetic applicator receptacle 16 when a pencil 24 is in its stored position within respective capsule 22. In a preferred embodiment of the present invention, the capsules 22 are permanently retained within the housing 12. As shown in FIG. 5, when a respective cosmetic applicator receptacle is arranged in its projected position, it will extend out of a respective aperture 14 of the housing 12. However, when a capsule 22 is arranged in its projected position, the first end 22*a* abuts a respective annular shoulder 15 adjacent an aperture 14. Such an arrangement is possible by making the outer diameter of the capsules 22 larger than the diameter across the apertures 14.

In accordance with another preferred embodiment of the present invention, a user of the cosmetic products and applicators stored within the cosmetic organizer 10 can access a variety of cosmetic products such as blush stored within trays 50*a*–50*d* by pivoting the cover 30 about the hinge 28 until the cover 30 is in its fully-opened position, as shown in FIG. 1. Additionally, as discussed above, when the cover 30 is in its open position, a user will have access to a mirror M on the inner wall of the cover 30.

In yet another preferred embodiment of the present invention, lipstick, lip gloss and the like is stored, along with an applicator 29, within a hidden compartment formed inside of the hinge 28. According to this preferred embodiment, the lipstick applicator 29 is retained in a stored position when the cover 30 is closed. However, when the cover 30 is moved to its open position as shown in FIG. 1, the lipstick automatically extends out of its compartment in hinge 28 as can be appreciated with reference to FIG. 2. The lipstick applicator 29 can then be removed, if desired, and lipstick can be applied to the lips of the user. When the user no longer desires to use the lipstick, it is inserted back into the compartment within the hinge 28 until it can be inserted no further. If the user places the applicator 29 back into the compartment when the cover 30 is in its open position, the lipstick will extend a predetermined distance out of the compartment. However, when the cover 30 is closed, the lipstick will retract into its stored position.

In the foregoing preferred embodiments, the cover 30 is pivotally connected to the housing 12 at the hinge 28. The connection between the cover and the housing has no bearing whatsoever on the structure and operation of the cosmetic applicator receptacles 16 that are releasably retained within respective apertures 14 and respective capsules 22 by means of the latch 32. Accordingly, there is no need to open the cover 30 if a user only desires to access one or more of the cosmetic pencils 24. Alternatively, there is no need to remove any of the cosmetic pencils 24 if a user only desires to access blush retained within one of the cosmetic trays 50*a*–50*d*.

While the foregoing description and figures are directed towards the preferred embodiments in accordance with the present invention, it should be appreciated that numerous modifications can be made to each of the components of the cosmetic organizer as discussed above, and are indeed encouraged to be made in the materials, structure and arrangement of the disclosed embodiments of the present invention without departing from the spirit and scope of same. Thus, the foregoing description of the preferred embodiments should be taken by way of illustration rather than by way of limitation with respect to the present invention as defined by the claims set forth below.

I claim:

1. A cosmetic organizer comprising:

a housing;

receptacle means for receiving and retaining at least one end of a cosmetic applicator, said receptacle means movable between a retracted position retained within said housing preventing removal therefrom and a projected position arranged at least partially outside of said housing permitting removal therefrom, said receptacle means being attached to the cosmetic applicator so that the cosmetic applicator is simultaneously removed from said housing when said receptacle means is removed therefrom;

moving means arranged in said housing for moving said receptacle means from said retracted position to said projected position; and locking means for selectively retaining said receptacle means in said retracted position within said housing, said locking means positionable between a first position wherein said locking means directly engages said receptacle means so that said receptacle means is retained in said retracted position and a second position wherein said locking means is disengaged from said receptacle means and said moving means is operative to move said receptacle means to said projected position.

2. The cosmetic organizer of claim 1 wherein said housing includes an interior and an exterior, said locking means having a release button control and an engagement portion, said release button control being arranged at least partially outside of said housing and said engagement portion being arranged within said interior of said housing.

3. The cosmetic organizer of claim 1 wherein said locking means comprises a first elongate member having a projection thereon, said projection being adaptable for releasably engaging said receptacle means to permit said receptacle means to move from said retracted position to said projected position.

4. The cosmetic organizer of claim 1 wherein said locking means includes pivot means arranged in said housing for facilitating movement of said locking means between said first position and said second position.

5. The cosmetic organizer of claim 4 wherein said locking means comprises a first elongate member having a projection thereon, said projection being adaptable for releasably engaging said receptacle means to permit said receptacle means to move from said retracted position to said projected position.

6. The cosmetic organizer of claim 5 wherein said pivot means comprises a second elongate member, said first and second elongate members defining respective first and second axes, said second elongate member being connected to said first elongate member so that said second axis is arranged transverse to said first axis, said second elongate member being rotatably mounted within said housing.

7. The cosmetic organizer of claim 3 wherein said first elongate member has an arcuate shape.

8. The cosmetic organizer of claim 3 wherein said receptacle means has a groove thereon, said groove being sized and shaped to accept said projection therein so that said receptacle means can be selectively retained in said retracted position.

9. The cosmetic organizer of claim 8 wherein said housing includes an interior and an exterior, said locking means having a release button control and an engagement portion, said release button control being arranged at least partially outside of said housing and said engagement portion being arranged within said interior of said housing.

10. The cosmetic organizer of claim 5 wherein said first elongate member has an arcuate shape.

11. The cosmetic organizer of claim 5 wherein said receptacle means has a groove thereon, said groove being sized and shaped to accept said projection therein so that said receptacle means can be selectively retained in said retracted position.

12. The cosmetic organizer of claim 5 wherein said housing includes an interior and an exterior, said locking means having a release button control and an engagement portion, said release button control being arranged at least partially outside of said housing and said engagement portion being arranged within said interior of said housing.

13. The cosmetic organizer of claim 12 wherein said pivot means comprises a second elongate member, said first and second elongate members having respective first and second axes, said second elongate member being connected to said first elongate member so that said second axis is arranged transverse to said first axis, said second elongate member being rotatably mounted within said housing.

14. The cosmetic organizer of claim 13 wherein said first elongate member has an arcuate shape.

15. The cosmetic organizer of claim 1 wherein said first elongate member has a first end and a second end, said first end being arranged to abut a portion of said interior of said housing and said second end being connected to said release button.

16. The cosmetic organizer of claim 1 further comprising tray means for storing at least one cosmetic product therein, said tray means being arranged on said exterior of said housing.

17. The cosmetic organizer of claim 16 further comprising a cover having an outer surface and an inner surface, said cover being pivotally connected to said housing so that said cover can be selectively moved between a closed position, at which said inner surface is arranged adjacent said tray means, and an open position, at which said inner surface is remote from said tray means.

18. The cosmetic organizer of claim 17 wherein said connection between said cover and said housing comprises a hinge, said hinge defining a sized and shaped compartment for retaining lipstick therein.

19. The cosmetic organizer of claim 18 further comprising lipstick projection means for moving said lipstick retained within said compartment between a projected position, at which the lipstick extends at least partially outside of said compartment, and a retracted position, at which said lipstick is retained within said compartment, said lipstick projection means being responsive to said opening and closing of said cover so that said lipstick will move from said retracted position to said projected position upon opening said cover and vice-versa.

20. The cosmetic organizer of claim 17 further comprising a mirror, said mirror being connected to said inner surface of said cover.

21. The cosmetic organizer of claim 1 further comprising sealing means for preventing said at least one cosmetic applicator from drying out, said sealing means being simultaneously movable with said receptacle means between said retracted and projected positions and being releasably connected to said receptacle means.

22. The cosmetic organizer device of claim 21 wherein said sealing means comprises a sized and shaped container arranged in said housing, said container having one opening therein and being releasably attached to said receptacle means at said opening.

23. A cosmetic organizer comprising:

a housing;

receptacle means for receiving and retaining at least one cosmetic applicator, said receptacle means being movable between a retracted position at which said receptacle means is retained within said housing so that it cannot be removed therefrom, and a projected position at which said receptacle means is arranged at least partially outside of said housing and can be readily removed therefrom;

moving means arranged in said housing for moving said receptacle means from said retracted position to said projected position;

locking means for selectively retaining said receptacle means in said retracted position within said housing; and sealing means for preventing said at least one cosmetic applicator from drying out, said sealing means being simultaneously movable with said receptacle means between said retracted and projected positions and being releasably connected to said receptacle means.

24. The cosmetic organizer of claim 23 wherein said sealing means comprises a sized and shaped container arranged in said housing, said container having one opening therein and being releasably attached to said receptacle means at said opening so that a seal is formed thereat.

25. A cosmetic organizer comprising:

a housing, receptacle means for receiving and retaining at least one end of a cosmetic applicator, said receptacle means movable between a retracted position retained within said housing preventing removal therefrom and a projected position arranged at least partially outside of said housing permitting removal therefrom, said receptacle means being attached to the cosmetic applicator so that the cosmetic applicator is simultaneously removed from said housing when said receptacle means is removed therefrom;

moving means arranged in said housing for moving said receptacle means from said retracted position to said projected position; and locking means for selectively retaining said receptacle means in said retracted position within said housing, said locking means positionable between a first position wherein said locking means directly engages said receptacle means so that said receptacle means is retained in said retracted position and a second position wherein said locking means is disengaged from said receptacle means and said moving means is operative to move said receptacle means to said projected position, said locking means comprising a first elongate member having a projection thereon, said projection being adaptable for releasable engaging said receptacle means to permit said receptacle means to move from said retracted position to said projected position, said receptacle means having a groove thereon, said groove being sized and shaped to accept said projection therein so that said receptacle means can be selectively retained in said retracted position.

* * * * *